United States Patent [19]

Tsukada

[11] 4,154,541

[45] May 15, 1979

[54] PRINTER HEAD ASSEMBLY

[75] Inventor: Toshiji Tsukada, Matsudo, Japan

[73] Assignee: Ricoh Company, Ltd., Japan

[21] Appl. No.: 806,065

[22] Filed: Jun. 13, 1977

[51] Int. Cl.[2] ..... B41J 3/12

[52] U.S. Cl. ..... 400/124; 101/93.05

[58] Field of Search ..... 101/93.05; 197/1 R; 400/124

[56] References Cited

U.S. PATENT DOCUMENTS

| | | | |
|---|---|---|---|
| 3,835,975 | 9/1974 | Howard | 197/1 R |
| 3,907,092 | 9/1975 | Kwan et al. | 197/1 R |
| 3,991,871 | 11/1976 | McIntosh | 197/1 R |
| 4,047,606 | 9/1977 | Ott | 197/1 R |

FOREIGN PATENT DOCUMENTS

| | | | |
|---|---|---|---|
| 2360435 | 6/1974 | Fed. Rep. of Germany | 197/1 R |

*Primary Examiner*—Paul T. Sewell

*Attorney, Agent, or Firm*—McGlew and Tuttle

[57] ABSTRACT

A printer head assembly for use in high speed printers of the dot-matrix type. The assembly includes a plurality of solenoids affixed to a bevelled rear wall of a bracket and arranged in such a manner that they are located equidistantly from one another on the circumference of the rear wall of the bracket and arranged at different heights in a vertical plane, and print wires of the same number as the solenoids extending diagonally inwardly from the associated solenoids at the same angle therewith and ultimately introduced into guide apertures formed in a lip guide so as to lie along an imaginary straight line in very closely spaced relationship. The print wires are each inserted in a conduit formed of material of a low coefficient of friction in the region between the bracket having a conduit support and a place slightly posterior to the entrance to the lip guide. A conduit holder is mounted in the vicinity of the forward ends of the conduits so as to enable the print wires to be introduced substantially in straight lines into the guide apertures in the lip guide.

16 Claims, 14 Drawing Figures

PRINTER HEAD ASSEMBLY

BACKGROUND OF THE INVENTION

This invention relates to a printer head assembly for use in high speed printers of the dot-matrix type.

Heretofore, proposals have been made to provide one or a plurality of wire guides in an intermediate portion of the printer head or at a forward end thereof so as to align in a predetermined vertical arrangement the free ends of print wires, each being coupled to a print wire driving solenoid at one end thereof, and to provide wire guides each for inserting therein a portion of the length of each print wire in the region which lies posterior to the wire guide or guides. Such proposals are disclosed in Japanese Utility Model Application No. 32824/75 and Japanese Utility Model Application No. 39367/75. Some disadvantages are associated with this type of guide device. In the device described, since the print wires are not straight but undergo elastic deformation (curved) in a free space between the guide conduits and the lip guide, the print wires tend to bend or vibrate in natural frequency during operation, with the result that frictional dragging of the print wires on the wire guide or guides increases or the response time of the print wires is lengthed.

SUMMARY OF THE INVENTION

Accordingly, this invention has as its object the provision of a printer head assembly which obviates all the aforesaid disadvantages of the prior art.

According to the invention there is provided a printer head assembly for use in printers of the dot-matrix type comprising: a printer head having a bracket attached to its rear end; a plurality of print wires; a plurality of print wire driving solenoids equal in number to said print wires and affixed to a rear wall of said bracket; said plurality of solenoids each being coupled to one of said print wires and located equidistantly on the circumference of an imaginary circle centering at the longitudinal center axis of said printer head in a manner to be inclined at an angle toward the forward end of the printer head with respect to said longitudinal center axis of the printer head so as to thereby drive said print wires on one-to-one basis; a lip guide affixed to a forward end of said printer head and having a plurality of guide apertures arranged to lie along an imaginary straight line for guiding said print wires; a plurality of conduits corresponding in number to said print wires and each enveloping one of said print wires in a region between said bracket and the vicinity of said lip guide; a conduit support means affixed to said bracket for supporting said conduits; a conduit holder located between said bracket and said lip guide and in the vicinity of said lip guide; front and rear conduit guide means disposed on the front and rear sides of the conduit holder for guiding said conduits in such a manner that said conduits are divided into two groups in a vertical plane including the longitudinal center axis of said printer head and arranged to lie along two imaginary vertical lines parallel to each other and disposed adjacent each other; said print wires extending from the respective conduits guided by said front and rear conduit guide means being inserted rectilinearly into the corresponding guide apertures formed in said lip guide. The print wire driving solenoids are arranged such that they are located at different heights in a vertical plane so as to enable the print wires to be introduced substantially in straight lines into the guide apertures in the lip guide. This eliminates the need to effect adjustment of the print wires in the vertical direction.

BRIEF DESCRIPTION OF THE DRAWINGS

Additional and other objects and features of the invention will become apparent from the description set forth hereinafter when considered in conjunction with the accompanying drawings, in which.

DESCRIPTION OF PREFERRED EMBODIMENTS

Figure 1:
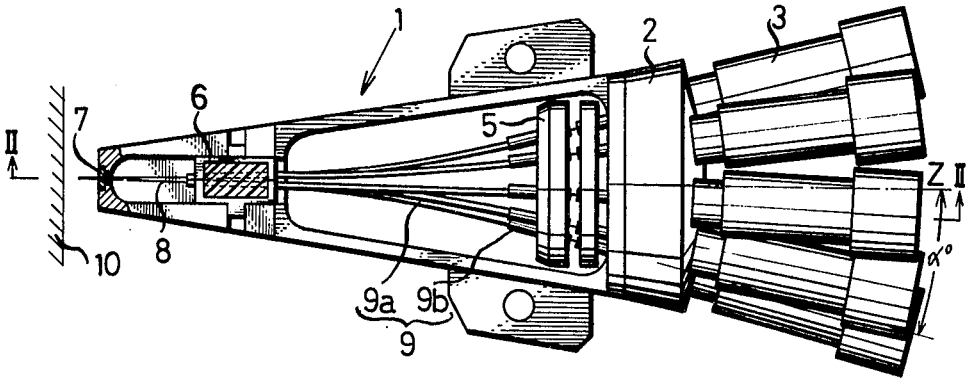
FIG. 1 is a plan view of a printer head assembly comprising one embodiment of the invention.
Figure 2:
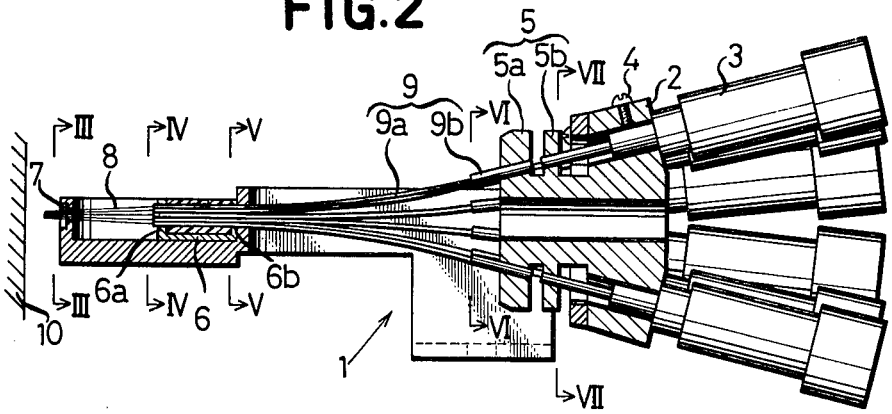
FIG. 2 is a sectional view taken along the line II—II of FIG. 1.
Figure 6:
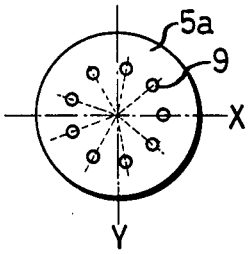
FIG. 6 is a schematic view of the front portion of the conduit support as seen in the direction of arrows VI—VI of FIG. 2.
Figure 7:
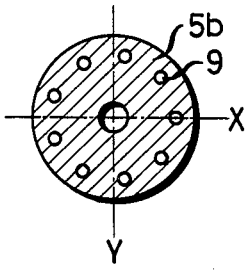
FIG. 7 is a schematic view of the rear portion of the conduit support as seen in the direction of arrows VII—VII of FIG,. 2.

Referring to FIGS. 1 and 2, a printer head designated by the reference numeral 1 includes a bracket 2 having a rear wall forming approximately a frustoconical shape which has a wire driving solenoid 3 secured thereto by a screw 4 in each of nine positions provided by equidistantly dividing the circumference of the circular rear wall of the bracket 2 into nine segments. The solenoids 3 are located such that their axes are inclined at an angle $\alpha$ with respect to the longitudinal center axis Z of the printer head 1 which is perpendicular to the surface of a template 10. Each print wire 8 coupled to one of the solenoids 3 and extending through a conduit 9 extends inwardly from the associated solenoid 3 and is arranged at the same angle $\alpha$ with respect to the longitudinal center axis Z of the printer head 1 by a conduit support 5 including a front guide portion 5*a* and a rear guide portion 5*b*. Thus the solenoids 3 and hence the conduits 9 extending inwardly from the conduit support 5 are arranged such that, as shown in FIG. 6 or FIG. 7, four conduits 9 are located on one side of the vertical center line Y and five conduits 9 are located on the other side thereof in such a manner that the five conduits 9 are arranged symmetrically with respect to the horizontal center line X and any of the lines dividing the circumference of an imaginary circle on the support 5 into nine arcuate segments does not coincide with the vertical center line Y. Stated differently, the nine conduits 9 are divided into two groups located on the left and right sides of the vertical center line Y in such a manner that the conduits of an even number $2n$ and the conduits of an odd number $2n + 1$ (n = 2) are arranged on the left and right sides thereof. However, when the total number of the print wires 8 is an even number, the print wires 8 are divided into two groups of equal number and arranged on the right and left sides of the vertical center line Y.

Figure 3:
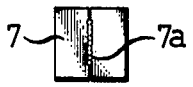
FIG. 3 is a schematic view of the lip guide as seen in the direction of arrows III—III of FIG. 2.

A conduit holder 6 is mounted between a lip guide 7 attached to a forward end of the printer head 1 and the conduit support 5, and formed with a front conduit guide 6*a* and a rear conduit guide 6*b* for gathering together the conduits 9, so that the print wires 8 extending from the guides 6*a* and 6*b* will be introduced into the lip guide 7 in straight lines. More specifically, each print wire 8 extends through one of the conduits 9 in the region of the conduit holder 6 but the portion of the print wire 8 disposed in front of this region extends in a straight line in a manner to be inserted in one of guide apertures 7*a* (FIG. 3), e.g. each formed in a jewel member, arranged vertically along an imaginary straight line in the lip guide 7.

The front conduit guide 6*a* comprises an opening consisting of two guide hole portions 6*a*-1 and 6*a*-2 extending vertically and disposed in juxtaposed relationship. The opening has dimensions and is shaped and configured in such a manner that the conduits 9 of an odd number (5) are located along an imaginary vertical straight line in one conduit guide hole portion 6*a*-1 and the conduits of an even number (4) are located along an imaginary vertical straight line in the other conduit guide hole portion 6*a*-2, and the conduits 9 arranged along two imaginary straight lines are disposed adjacent each other in staggered relationship.

Figure 5:
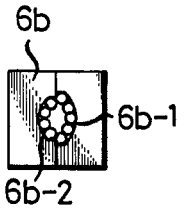
FIG. 5 is a schematic view of the rear conduit guide as seen in the direction of arrows V—V of FIG. 2.

The rear conduit guide 6*b* interposed between the conduit support 5 and the front conduit guide 6*a* includes an opening for performing the function of changing the conduits 9 extending inwardly from the conduit support 5 from an equidistantly spaced relationship and with an inclination at an angle $\alpha°$ as shown in FIG. 1, into a two vertical straight line arrangement as shown in the front conduit guide 6*a*. The opening in the rear conduit guide 6*b* consists of two guide hole portions 6*b*-1 and 6*b*-2 which, as shown in FIG. 5, have suitable arcuate surfaces facing each other. The conduits 9 guided along the two arcuate surfaces of the rear guide holes 6*b*-1 and 6*b*-2 are of the odd number and the even number respectively as is the case with the front conduit guide 6*a*. However, the two groups of conduits 9 do not lie along straight lines disposed ajacent each other but are spaced apart from each other a suitable distance.

In the embodiment shown and described herein, the conduit holder 6 is divided into two halves along a vertical plane including the longitudinal center axis Z of the printer head 1 in such a manner that cutouts are formed on the edges of the two halves of the conduit holder 6 and serve as guide hole portions 6*a*-1, 6*a*-2, 6*b*-1 and 6*b*-2. By this arrangement, production and adjustment of the positions of the front and rear conduit guides 6*a* and 6*b* are facilitated.

Of the conduits 9 extending outwardly from the conduit support 5, the conduits of the odd number located on one side of the vertical center line Y as shown in FIG. 6 extend through the conduit guide hole portions 6*b*-1 and 6*a*-1, while the conduits 9 of the even number located on the other side thereof extend through the conduit guide hole portions 6*b*-2 and 6*a*-2. All the conduits 9 terminate at a place slightly anterior to the conduit holder 6. The print wires 8 extending from the forward ends of the conduits 9 are inserted in the guide apertures 7*a*, arranged to lie along an imaginary vertical line in the lip guide 7, in such a manner that the print wires 8 located on the right half portion with respect to the vertical center line Y in FIG. 6 in which the print wires 8 are arranged symmetrically with respect to the horizontal center line X are first inserted in the guide apertures 7*a* beginning with the print wire 8 disposed at the highest position in FIG. 6. In this case, the rear conduit guide 6*b* gathers the conduits 9 together in such a mannner that the forward ends of the print wires 8 extending rectilinearly from the front ends of the conduits 9 are aligned with the respective guide apertures 7*a* of the lip guide 7. Each of the conduits 9 is supported at three places by the conduit support 5, the rear conduit guide 6*b* and the front conduit guide 6*a*, and gradually subjected to elastic deformation in the free space between the conduit support 5 from which it extends forwardly and the front conduit guide 6*a* in which all the conduits 9 are arranged along imaginary two vertical lines in the guide hole portions 6*a*-1 and 6*a*-2.

Figure 8:
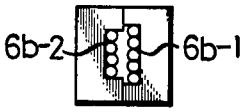
FIG. 8 is a view similar to FIG. 5 but showing another embodiment.

It is not mandatory that the guide hole portions 6*b*-1 and 6*b*-2 of the rear conduit guide 6*b* have arcuate surfaces. These guide holes may be of any configuration as desired so long as they can guide the conduits 9 in such a manner that the print wires 8 extending from the forward ends of the conduits can be introduced rectilinearly into the guide apertures 7*a* of the lip guide 7 at the forward end of the printer head 1. It is possible to form the guide hole portions 6*b*-1 and 6*b*-2 in an any shape as desired depending on the manner of mounting of the solenoids 3 affixed to the bracket 2 and the arrangement of and the spacing between the conduits 9 extending from the conduit support 5. For example, the opposing surfaces of the guide hole portions 6*b*-1 and 6*b*-2 may be of other shape than arcuate as shown in FIG. 8. Also, the rear conduit guide 6*b* may be formed as an independent adjustable guide which can change its position longitudinally of the conduits 9.

Figure 9:
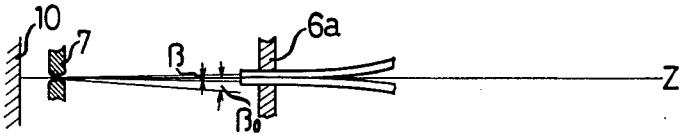
FIG. 9 is a diagrammatic view of the print wires extending from the leading ends of the associated conduits and introduced into the lip guide.

The print wires 8 whose courses are adjusted as aforesaid by supporting the conduits by the guides 5, 6*a* and 6*b* extend, as shown in FIG. 9, from the leading ends of the conduits 9 and are introduced rectilinearly into the guide apertures 7*a* of the lip guide 7 at an angle $\beta$ with respect to the longitudinal center axis Z of the printer head 1. In this case, if play of the print wires 8 due to tolerances in the dimensions of the printing wires 8 and the guide apertures 7*a* is considered, the angle at which the print wires 8 are introduced into the guide apertures 7*a* will have a tolerance of angle $\beta o$. Thus, even if the print wires 8 are introduced into the guide apertures 7*a* in tilting fashion, the print wires 8 will smoothly extend through the guide apertures 7*a* and no adverse effects will be exerted on the printing operation, in case the angle $\beta$ is within the allowable angle $\beta o$. This in turn means that it is possible to change the shape and configuration and the spacing between the inner surfaces of the guide hole portions 6*b*-1 and 6*b*-2 of the rear conduit guide 6*b*, so long as the angle $\beta$ at which the print wires 8 are introduced into the guide apertures 7*a* remains within the allowable angle $\beta o$. Additionally, the print wires 8 may be introduced into the guide apertures 7*a* in such a manner that the center of each of the conduits 9 arranged along one of the two vertical imaginary lines by the front conduit guide 6a is brought into alignment with the longitudinal center axis Z of the printer head 1 or the angle $\beta$ is made zero $\beta = 0$ while the center of each of the conduits 9 arranged along the other vertical imaginary line forms an angle $2\beta$ with respect to the longitudinal axis Z of the printer head 1.

Displacement of the print wires 8 at the leading ends of the conduits 9 from the respective guide apertures 7a of the lip guide 7 can be minimized if the conduits 9 are separated into upper and lower groups of conduits with the center aperture of the guide apertures 7a as the center. This eliminates the need to effect adjustments of the print wires 8 in the vertical direction by the rear conduit guide 6b. Even if such adjustments are necessary, they can be effected readily.

According to the present invention, conduits 9 for guiding the print wires 8 are gathered together by the front and rear conduit guides 6a and 6b and supported thereby so as to enable the print wires 8 to be introduced rectilinearly into the respective guide apertures 7a of the lip guide 7. Thus, less abrasive wear is caused on the print wires 8 by the guide apertures 7a, and the vibration and amplitude of the print wires 8 are restricted. It will be appreciated that the invention provides a printer head assembly in which the print wires 8 operate with a high degree of responsiveness and permits a printer of the dot-matrix type to operate at high speeds.

Figure 10:
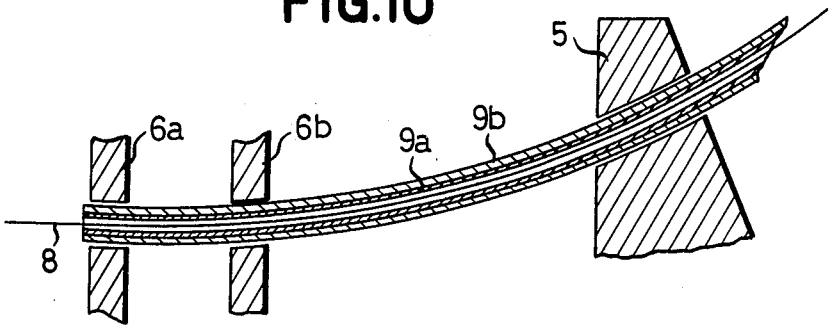
FIG. 10 is a fragmentary enlarged view of FIG. 1.

The conduits 9 are each advantageously formed as a composite conduit comprising, as shown in FIG. 10, an inner conduit layer 9a and an outer conduit layer 9b. More specifically, the inner conduit layer 9a, directly maintained in contact with the print wire 8, is preferably formed of a synthetic resinous material or other material of a low coefficient of friction, and the outer conduit layer 9b is preferably made of stainless steel or other material of sufficiently high strength and flexibility to enable the conduit 9 to function satisfactorily as a wire guide. The use of the inner conduit layer 9a formed of the aforesaid material ensures that the print wire 8 moves smoothly in sliding motion within the conduit 9. The provision of the outer conduit layer 9b permits the conduits 9 to be deformed and arranged as desired when the latter are passes through the conduit support 5 and gathered together in the conduit holder 6. Thus the use of the composite conduits 9 enables the print wires 8 to move smoothly in sliding motion without requiring the application of a lubricant to the print wires 8, and makes it possible to select materials for the inner and outer conduit layers 9a and 9b with greater ease than when the conduits 9 are formed of a single layer.

Figure 11:
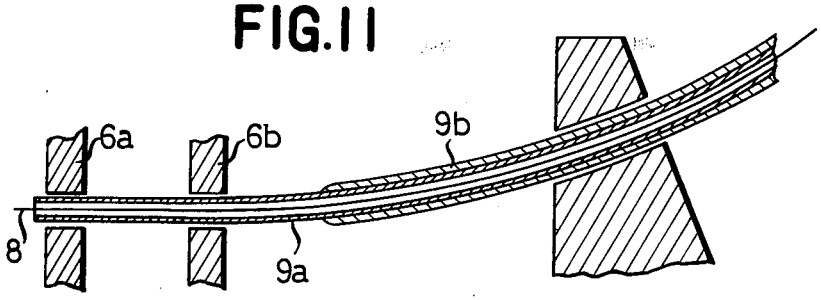
FIG. 11 is a view similar to FIG. 10 but showing another embodiment.

Since the conduits 9 are supported by the front and rear guides 6a and 6b at which the conduits undergo a high rate of elastic deformation, the print wires 8 undergo substantially no deformation throughout the entire region of the conduits 9 when the print wires 8 perform a printing operation. Thus, the need to provide a composite conduit through the entire length thereof can be eliminated. For example, the conduits 9 in the form of composite conducts may, as shown in FIG. 1 and 11, terminate at a point which is slightly beyond the conduit support 5 or where the conduits 9 are introduced into the rear conduit guide 6b, and the conduits 9 may consist only of the inner conduit layer 9b in the portion thereof which extends from this point to the front conduit guide 6a.

However, the portion of each conduit 9 consisting only of the inner conduit layer 9a tends to undergo deformation and is hard to support. Therefore, in actual practice, a difficulty is encountered in positively supporting the conduits 9 each consisting only of the inner conduit layer 9a. Thus, during a printing operation, the portion of each conduit 9 consisting only of the inner conduit layer 9a exerts adverse influences on the printing operation and lowers its efficiency because of the facts that such portion of each conduit 9 tends to bend or vibrate in natural vibration. Therefore, it is advantageous to charge a cementing agent 11 in the conduit holder 6 between the front and rear conduit guides 6a and 6b so as to firmly cement the conduits 9 into position when the cementing agent 11 sets.

Figure 4:
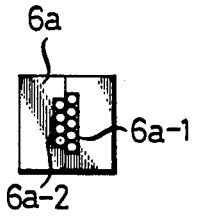
FIG. 4 is a schematic view of the front conduit guide as seen in the direction of arrows IV—IV of FIG. 2.
Figure 14:
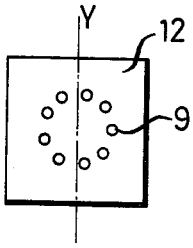
FIG. 14 is a schematic view of the conduits converging guide as seen in the direction of arrows XIV—XIV of FIG. 13.
Figure 12:
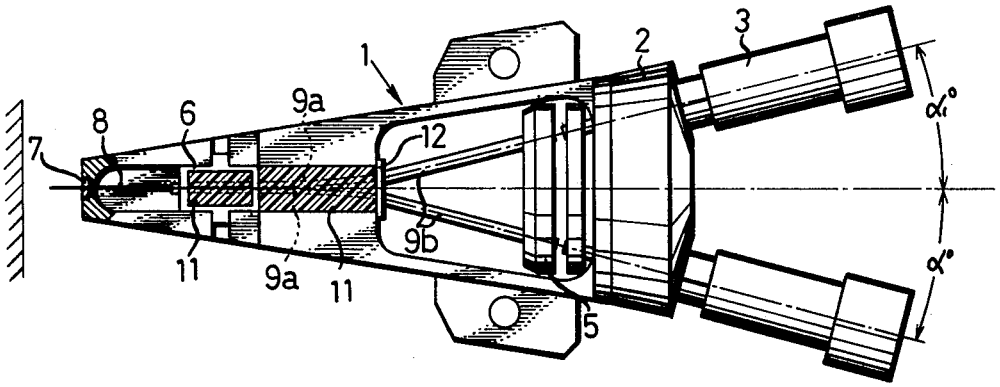
FIG. 12 is a plan view of the printer head assembly comprising another embodiment of the invention.
Figure 13:
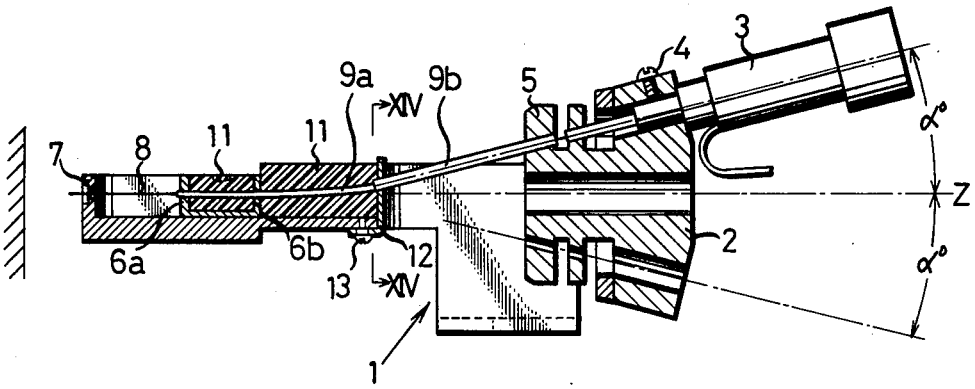
FIG. 13 is a vertical sectional view of the printer head assembly shown in FIG. 12.

FIGS. 12 and 13 show another embodiment of the invention in which only two solenoids 3 and the print wires 8 associated therewith are shown in the interest of clarity. As shown, the print wires 8 extending through the composite conduits 9 are led through the conduit support 5 and then led through a conduits converging guide 12 (FIG. 14) secured to the printer head 1 by means of screws 13. The portion of each print wire 8 located in the conduits converging guide 12 is inserted in only the inner conduit layer 9a because the outer conduit layer 9b terminates at the entrance to the guide 12. Then the portion of each print wire 8 inserted in only the inner conduit layer 9a is led to the conduit holder 6, from which only the print wire 8 is inserted in one of the guide apertures 7a, formed in the lip guide 7 (FIG. 3), without being guided by the conduit. Like the embodiment shown in FIG. 1, this embodiment comprises the front conduit guide 6a (FIG. 4) and the rear conduit guide 6b (FIG. 5) disposed in the front and rear of the conduit holder 6 respectively. By means of these guides, the conduits 9 each consisting only of the inner conduit layer 9a are further gathered together and supported in such a manner the print wires 8 are introduced rectilinearly into the respective guide apertures 7a formed in the lip guide 7 and arranged along an imaginary vertical straight line.

In the regions where each print wire 8 is inserted in only the inner conduit layer 9a or between the front and rear conduit guides 6a and 6b of the conduit holder 6 and between the rear conduit guide 6b and the conduits converging guide 12, the cementing agent 11 is charged so as to hold conduits 9 consisting only of the inner conduit member 9a in the desired shape by firmly cementing them into position. By this arrangement, the inner conduit layer 9a which is flexible can be held in the desired shape in the printer head 1 as it is firmly cemented into position in the conduit converging guide 12 or the conduit holder 6. After the conduits 9 consisting only of the inner conduit layer 9a are cemented in place, the conduits converging guide 12 may be removed.

In this embodiment, the print wires 8 do not undergo elastic deformation in the free region in which the print wires 8 extend after they have cleared the front conduit guide 6a and before being introduced into the guide apertures 7a formed in the lip guide of a synthetic jewel, because the portion of each conduit 9 which tends to be bent or the portion thereof which consists only of the inner conduit layer 9a is held in place by means of the cementing agent and the front and rear conduit guides 6a and 6b. Thus, the print wires 8 do not undergo vibration in the free region. As a result, the response time of the print wires 8 can be shortened.

In all the embodiment shown and described herein, the printer head assembly has been shown and described as comprising solenoids and hence print wires in odd number. It is to be understood, however, that the number of the solenoids and hence the print wires is not limited to the odd number and that the invention can have application in a printer head assembly comprising solenoids and print wires in even number. In the event that the solenoids and the print wires are in even number, the guide hole portions of the front and rear conduit guides 6*a* and 6*b* are arranged along two imaginary vertical lines each line including conduits in even number. The arrangement of the conduits extending inwardly from the conduit support 5 is such that, as described previously with reference to FIG. 6, the conduits of the same number are arranged on the left and right sides of the vertical center line Y, and that the positions of the conduits and hence the solenoids are determined such that their vertical positions vary slightly from one another without any of the lines which divide the circumference of an imaginary circle on the support 5 into arcuate segments of an even number coinciding with the vertical center line Y.

What I claim is:

1. A printing head assembly for use in printing of the dot-matrix type having a forward end and a rear end comprising a bracket located at the rear end of said printing head, a plurality of solenoids spaced about the longitudinal axis of said bracket, said solenoids being inclined at an angle toward the forward end of said printing head with respect to said longitudinal axis, a lip guide located at the forward end of said assembly, said lip guide having a plurality of guide apertures arranged in a line therein, a plurality of conduits corresponding to said solenoids and extending forwardly of said bracket, a conduit support disposed forwardly of said bracket for supporting said conduits, a conduit holder located between said conduit support and said lip guide and adjacent said lip guide, said conduit holder having a front and rear guide means for guiding said conduits so that said conduits are divided into two groups with the conduits in each group being disposed in alignment in side by side arrangement in said front guide means, a print wire extending through each of said conduits, each of said print wires being coupled to one of said solenoids to be driven thereby, and said print wire extending in a straight line forwardly of the respective conduits guided by said front and rear guide means being extended through said guide apertures of said lip guide in a straight line, wherein the two groups of conduits disposed in said front guide means in side by side relationship are vertically staggered.

2. A printing head assembly as defined in claim 1, wherein each of said conduits comprises an inner conduit layer and an outer conduit layer, said inner layer being formed of a material having a low coefficient of friction, and said outer conduit layer being formed of flexible material having sufficient strength to guide said conduits therein.

3. A printing head assembly as defined in claim 1 wherein said solenoids and conduits extending therefrom are located on a circle having as its center said longitudinal axis whereby said conduits are equidistantly spaced about said circle so that said conduits are divided into two groups located to either side of a vertical diameter of said circle.

4. The printing head as defined in claim 3 wherein said conduits spaced about said circle are vertically staggered.

5. A printing head as defined in claim 1 wherein said outer conduit layer terminates rearwardly of said conduit holder.

6. A printing head as defined in claim 1 and including a means for bonding said conduits extending between said front and rear guide means of said conduit holder.

7. A printing head as defined in claim 1 and including a conduit converging guide disposed between said rear guide means of said conduit holder and said conduit support, said converging guide having a corresponding series of openings for receiving said conduits, said outer conduit layer terminating at said converging guide, and means for bonding said conduits extending between said converging guide and said rear conduit guide means of said conduit holder.

8. A printer head assembly for use in printers of the dot-matrix type having a forward end and a rear end comprising: a bracket located at the rear end of said printer head; a plurality of print wires; a plurality of solenoids equal in number to said print wires and affixed to a rear wall of said bracket; said solenoids each being coupled to one of said print wires and located equidistantly on the circumference of an imaginary circle centering at the longitudinal center axis of said bracket in a manner to be inclined at an angle toward the forward end of said printer head with respect to said longitudinal center axis so as to thereby drive said print wires on a one-to-one basis; a lip guide affixed to a forward end of said printer head and having a plurality of guide apertures arranged to lie along an imaginary vertical line for guiding said print wires; a plurality of conduits corresponding in number to said print wires and each enveloping one of said print wires in a region between said bracket and a location spaced backwardly from said lip guide; a conduit support means affixed to said bracket for supporting said conduits; a conduit holder located between said conduit support means and said lip guide and spaced from said lip guide, said conduit holder having a front and rear conduit guide means for guiding said conduits in such a manner that said conduits are divided into two groups in a vertical plane including the longitudinal center axis of said printer head and arranged to lie along two imaginary vertical lines parallel to each other and disposed adjacent each other; each of said conduits being supported at said conduit support means, said rear conduit guide means and said front conduit guide means and being gradually subjected to elastic deformation between said conduit support means and said front conduit guide means, and oriented in the region between said front and rear conduit guide means so that each of the forward ends of said conduits directs its enveloped print wire rectilinearly into one of said corresponding guide apertures formed in said lip guide, said print wires each extending from the forward end of its respective conduit in a straight line in said space between said conduits and said lip guide and extending in a straight line through the corresponding guide apertures formed in said lip guide.

9. A printer head assembly as set forth in claim 8, wherein said plurality of conduits each comprise a composite conduit comprising an inner conduit layer formed of material of a low coefficient of friction and an outer conduit layer made of material having sufficient hardness to prevent buckling and vibration of said print wire, the rear end of said outer conduit layer being supported at said conduit support means and a forward end of said outer conduit layer terminating in a region between said conduit support means and said rear conduit guide means.

10. A printer head assembly as set forth in claim 8, wherein said front conduit guide means includes an opening for guiding all of said conduits in common, said opening having two guide hole portions of a configuration such that said conduits lie along two imaginery spaced vertical straight lines parallel to each other and are arranged in staggered relationship.

11. A printer head assembly as set forth in claim 9, further comprising a conduits converging guide means disposed between said conduit support means and said rear conduit guide means, and wherein each of said print wires is inserted in both said inner and outer conduit layers in the region between said conduit support means and said conduits converging guide means.

12. A printer head assembly as set forth in claim 10, wherein said conduit holder is divided into two halves along a vertical plane including the longitudinal center axis of said printer head with cutouts formed on the edges of two halves of said conduit holder to define said guide hole portions.

13. A printer head assembly as set forth in claim 8, wherein said rear conduit guide means in disposed nearer to said conduit support means than said front conduit guide means and operative to divide the conduits extending forwardly from the conduit support into two groups in a vertical plane including the longitudinal center axis of said printer head, said two groups of guides being arranged to lie along two imaginary lines disposed in spaced juxtaposed relationship.

14. A printer head assembly as set forth in claim 13, wherein said rear conduit guide means includes an opening having two guide hole portions transversely opposed to each other.

15. A printer head assembly as set forth in claim 14, wherein a cementing agent is disposed in said conduit holder between said front and rear conduit guide means so as to firmly cement said conduits into position.

16. A printer head assembly as set forth in claim 8, wherein said print wire driving solenoids are arranged such that they are located at different heights in a vertical plane.

* * * * *